US006604332B1

(12) United States Patent
Hughes et al.

(10) Patent No.: US 6,604,332 B1
(45) Date of Patent: Aug. 12, 2003

(54) LIGHT WELL BARRIER FOR SKYLIGHTS

(75) Inventors: Michael Anthony Hughes, Chandler, AZ (US); Thomas Keath Skripps, Phoenix, AZ (US)

(73) Assignee: Pure-Logic Industries, Inc., Gilbert, AZ (US)

( * ) Notice: Subject to any disclaimer, the term of this patent is extended or adjusted under 35 U.S.C. 154(b) by 0 days.

(21) Appl. No.: 09/644,114

(22) Filed: Aug. 22, 2000

Related U.S. Application Data

(60) Provisional application No. 60/150,387, filed on Aug. 24, 1999.

(51) Int. Cl.[7] ..... E04B 7/18
(52) U.S. Cl. ..... 52/311.3; 52/200; 49/62
(58) Field of Search ..... 52/200, 311.3; 49/62, 171

(56) References Cited

U.S. PATENT DOCUMENTS 3,934,383 A * 1/1976 Perry et al. ..... 52/200
3,996,844 A * 12/1976 Leurent ..... 52/200 X
4,016,699 A 4/1977 Hurvitz
4,175,357 A 11/1979 Goldhaber
4,384,436 A 5/1983 Green
4,395,861 A 8/1983 Fipke et al.
4,449,340 A * 5/1984 Jentoft et al. ..... 52/200
4,452,011 A 6/1984 Trombettas
4,505,069 A 3/1985 Freeman
4,555,867 A 12/1985 Stibolt
4,733,505 A 3/1988 Van Dame
4,817,334 A 4/1989 Badger et al.
5,207,036 A * 5/1993 Sampson et al. ..... 52/200 X
5,313,748 A 5/1994 Hughes, Jr.
5,392,564 A 2/1995 Fechter et al.
5,669,186 A * 9/1997 Verby et al. ..... 52/200 X
5,873,198 A 2/1999 DeMario

* cited by examiner

*Primary Examiner*—David M. Purol
(74) *Attorney, Agent, or Firm*—Richard E. Oney

(57) ABSTRACT

A barrier assembly for a skylight well opening includes a framework having a peripheral frame sized to circumscribe the light well opening. The framework can be secured in a position relative to a ceiling surface so that the peripheral frame circumscribes the light well opening. A grillwork is adapted to mate with the framework in a closed position wherein the grillwork and framework define a panel space. A light-transmissive panel is sized to fit within the panel space between the grillwork and the framework. The grillwork is hingedly attached to the framework so that that the grillwork and framework can be moved between an open position and the closed position. The grillwork is adapted to releasably attach to the framework in the closed position.

18 Claims, 2 Drawing Sheets

LIGHT WELL BARRIER FOR SKYLIGHTS

RELATED APPLICATION

This application claims the benefit of U.S. Provisional Application No. 60/150,387, filed Aug. 24, 1999, entitled "Light Well Barrier for Skylights," which is incorporated herein by reference.

BACKGROUND

This invention relates to an improved barrier assembly for enclosing a skylight well. More particularly, it relates to an improved barrier assembly that provides security from entry through the skylight, a thermal barrier between the skylight and the room, light intensity control and a decorative grill.

Skylights are commonly used in buildings to provide "free" natural light for illuminating rooms within the building. Many skylights include a skylight frame and dome system mounted over a skylight well that is incorporated into the structure of the building and which opens into the room to be lighted. For many reasons, it is desirable to block or control the space within the skylight well. For example, for security reasons it is desirable to block physical access to the room through the opening of the light well to prevent unauthorized entry into the room. In addition, it is desirable to control light intensity and heat transfer into and out of the room through the skylight well, such as by reducing light and heat transfer through the skylight well into a room during hot summer months.

To address these concerns, previous skylight systems have utilized relatively complex and/or costly solutions. For example, many of these systems utilize actuating enclosure systems, complex motorized systems, louvered blind arrangements or heavy bars. In addition to being costly, these systems require professional installation and often are esthetically displeasing. Moreover, these systems are not designed for use with existing skylights with minimal modification to the skylight. Rather, the use of such systems typically requires replacing the existing skylight system entirely. Thus, these systems are not designed to work with the majority of existing skylights, which have a simple dome with a frame mounted in the roof over a ceiling light well incorporated into the roof structure.

Therefore, there is a need for an improved skylight well barrier that can provide security from entry through the skylight, a thermal barrier between the skylight and the room and a light intensity control, and is more aesthetically pleasing. Accordingly, it is an object of this invention to provide such an apparatus.

It is yet another object of the invention to provide such a skylight well barrier that is relatively inexpensive and can easily be installed and used with an existing skylight without removing or modifying the skylight.

Additional objects and advantages of the invention will be set forth in the description that follows, and in part will be apparent from the description, or may be learned by practice of the invention. The objects and advantages of the invention may be realized and obtained by means of the instrumentalities and combinations pointed out in the appended claims.

SUMMARY

To achieve the foregoing objects, and in accordance with the purposes of the invention as embodied and broadly described in this document, I have provided a barrier assembly for a skylight well opening in a ceiling surface. The barrier assembly includes a framework having a peripheral frame sized to circumscribe the light well opening, securing means for securing the framework in a position relative to the ceiling surface so that the peripheral frame circumscribes the light well opening, a grillwork adapted to mate with the framework in a closed position wherein the grillwork and framework define a panel space, a light-transmissive panel sized to fit within the panel space and fastener means for securing the grillwork to the framework in the closed position.

In one advantageous embodiment of the barrier assembly, the frame is substantially flat and includes a hinge member. The frame can be mounted to a ceiling structure with fastening hardware. The grillwork includes a grill panel, a peripheral member and a hinge member adapted to hingedly attach to the framework hinge member so that the grillwork and framework can be moved between an open position and the closed position. The grillwork is adapted to releasably attach to the framework in the closed position. The panel space is defined, at least in part, by a recess in the grillwork, which can be defined in part by a spacer disposed on the framework. The panel space also can be defined, at least in part, by a recess in the framework, which can be defined in part by a spacer disposed on the framework. When the barrier assembly is in the closed position, the light-transmissive panel is held in place between the framework and the grillwork. The fastener means can include threaded inserts secured in the framework, and the threaded inserts can be corrosion resistant. The framework and grillwork can have a corrosion-resistant finish. The light-transmissive panel can be comprised of a variably transparent plastic panel to function as a thermal barrier. The panel can have light reducing properties, such as a smoked-color, to control the intensity of the light entering the room.

BRIEF DESCRIPTION OF THE DRAWINGS

The accompanying drawings, which are incorporated in and constitute a part of the specification, illustrate the presently preferred embodiments and methods of the invention. Together with the general description given above and the detailed description of the preferred embodiments and methods given below, they serve to explain the principles of the invention.

DESCRIPTION

Figure 2:
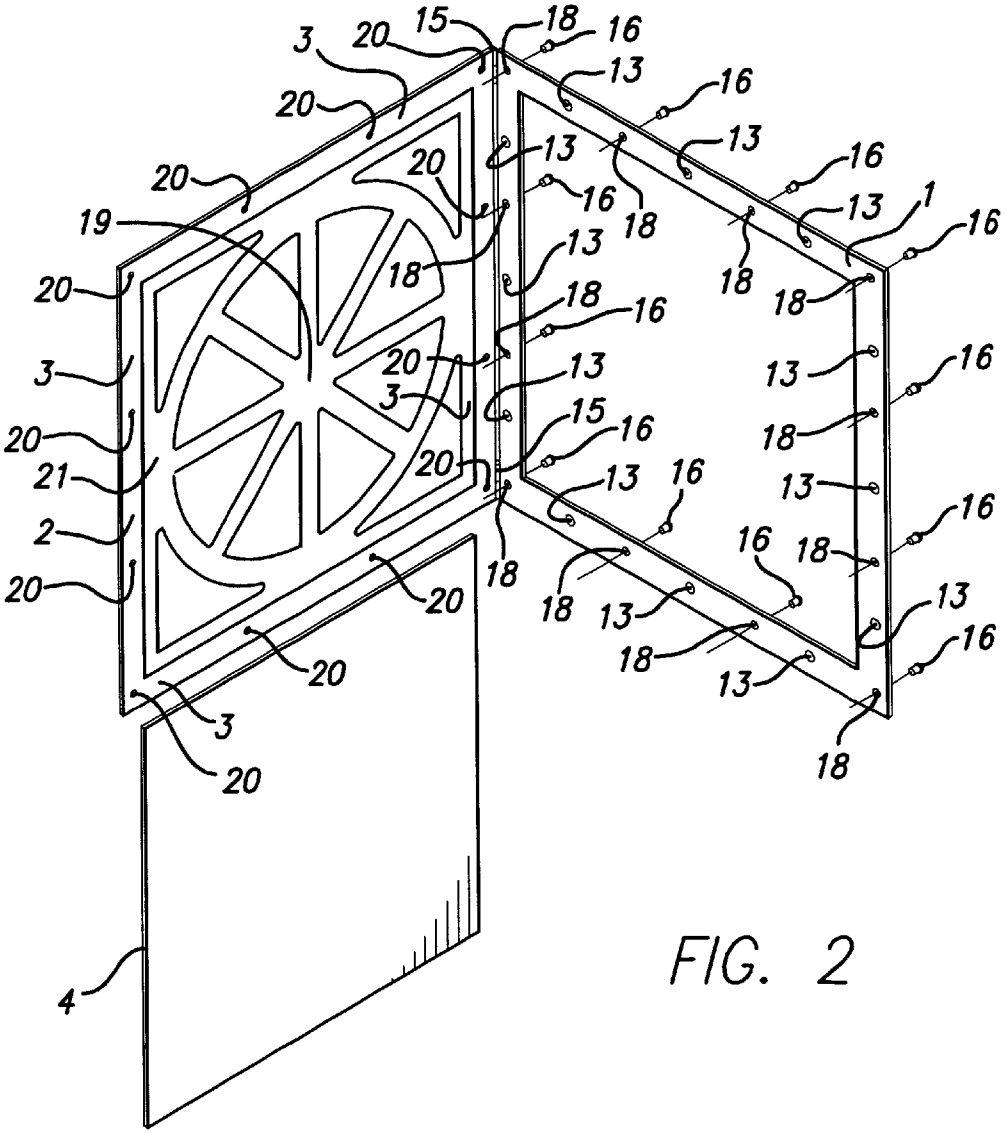
FIG. 2 is perspective view of the light well barrier assembly of FIG. 1 showing the assembly in the open position with the light-transmissive panel removed.

Reference will now be made in detail to the presently preferred embodiments and methods of the invention as illustrated in the accompanying drawings, in which like reference characters designate like on corresponding parts throughout drawings.

Figure 1:
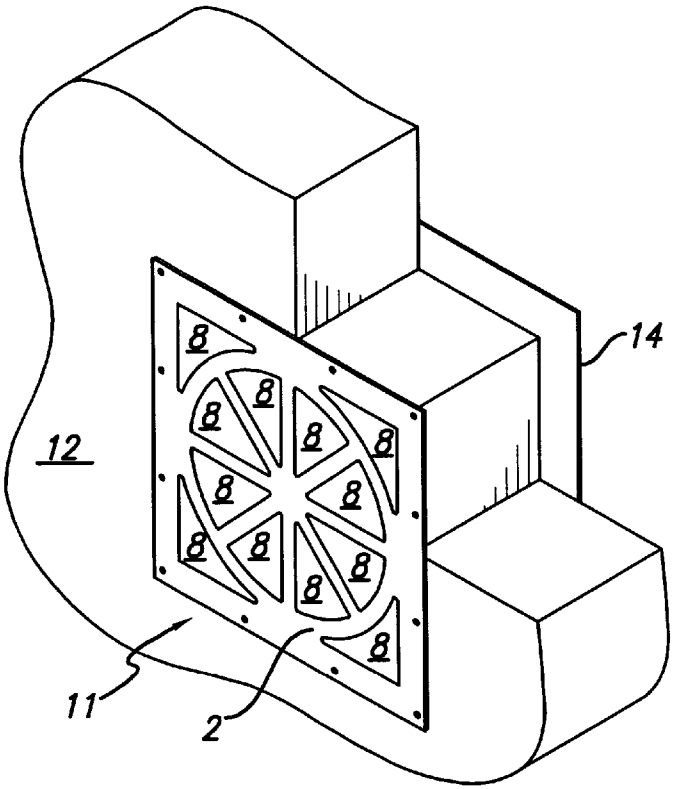
FIG. 1 is a perspective, partially sectioned view of a skylight well showing one embodiment of a light well barrier assembly according to the present invention, which is mounted to the ceiling to over the light well opening.

Referring to FIGS. 1 through a presently preferred embodiment of a skylight well barrier assembly 11 according to the present invention is shown. FIG. 1 illustrates a the barrier assembly 11 mounted to a ceiling surface 12 over a light well opening 8, thereby providing a barrier between a skylight 14 and the interior of the lighted room. As shown in more detail in FIG. 2, the barrier assembly 11 includes a framework 1, a grillwork 2 and a light-transmissive panel 4. The framework 1 is in the form of a substantially flat peripheral frame that is of a size and shape to circumvent the light well opening 8. Mounting holes 13 are disposed in the framework 1 so that the framework 1 can be mounted to the ceiling structure using flush mounted fasteners (not shown), such as flat head screws, nails or any other suitable flush mount fasteners. Threaded holes 18 are provided in the framework 1 to allow the grillwork 2 to be secured to the framework 1, as described below, when the barrier assembly 11 is in a closed position.

In a preferred embodiment, the framework 1 is constructed from steel sheet material and is painted or coated with another finish known in the art that is suitable for protecting the framework against corrosion. Threaded inserts 16 are pressed into holes in the framework 1 to form the threaded holes 18. The threaded inserts 16 can be formed from material having corrosion resistant properties so that corrosion will not degrade the framework if the assembly 11 is installed in a high moisture environment, such as in a bathroom. Half-hinge member 15 are mounted to an edge of the framework 1.

Figure 3:
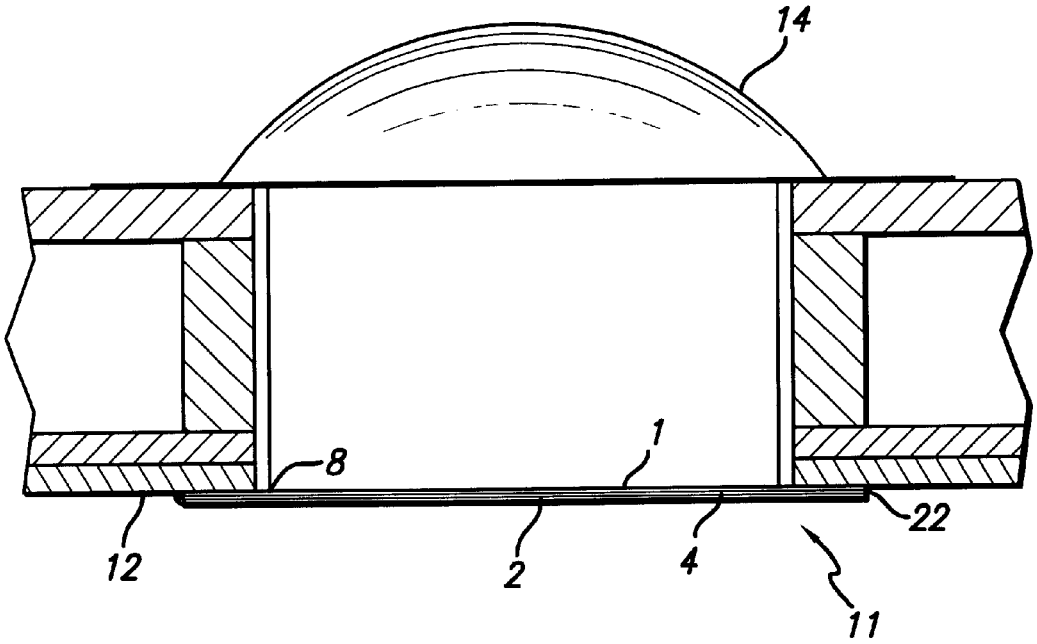
FIG. 3 is an elevation view showing the skylight dome, the light well and the barrier assembly of FIG. 1, with the assembly in the closed position.
Figure 4:
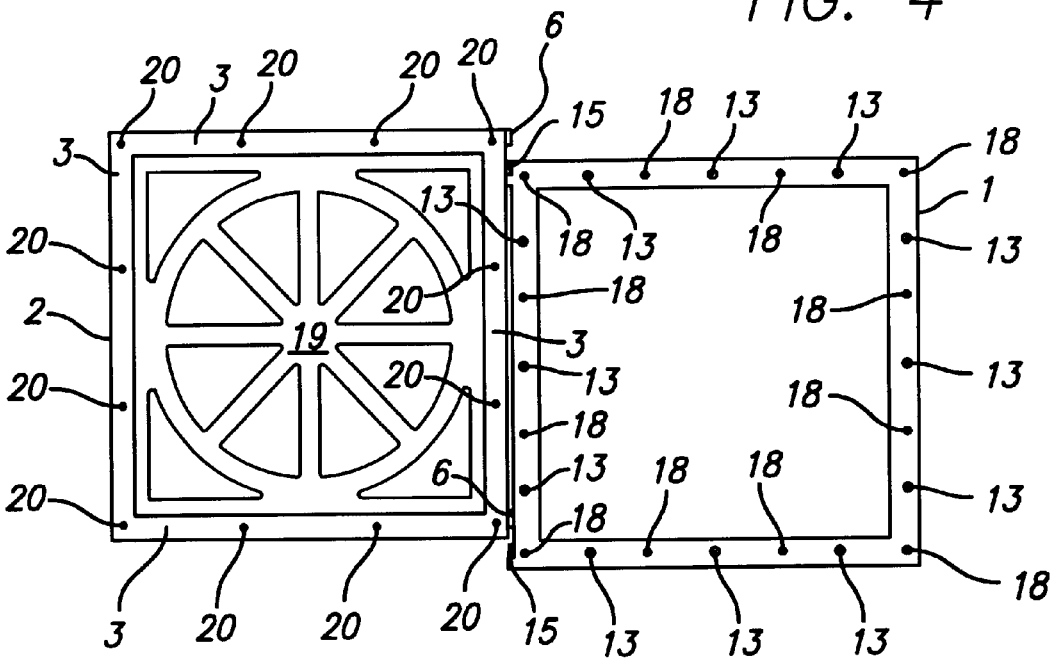
FIG. 4 is an exploded view of the grillwork and framework of the assembly of FIG. 1 showing more detail of the hinge mechanism with the grillwork and framework disconnected from each other.

The grillwork 2 includes a decorative grill panel 19. Spacer strips or members 3 are mounted along the outer border of the grill panel 19. The spacer strips 3 can be mounted to the grill panel 19 by any suitable method known in the art, such as by welding the spacer strips 3 along the perimeter of the grill panel 19. In this configuration the grill panel 19 and the spacer strips 3 form a panel recess 21 for holding the light-transmissive panel 4. Holes 20 extend through the grill panel 19 and the spacer strips 3 and are positioned to align with the corresponding threaded holes 18 in the framework 1. In this configuration, threaded fasteners (not shown) can be inserted into the holes 20 and threaded holes 18 to secure the grillwork 2 to the framework 1. Half-hinge members 6 are mounted to an edge of the grillwork 2 and are positioned and adapted to mate with the corresponding half hinge members 15 on the framework 1 to hingedly attach the grillwork 2 to the framework 1. In this configuration the grillwork 2 can be moved between an open position (see FIG. 2) and a closed position (see FIGS. 1 and 3). In the closed position, the grillwork 2 and the inner edge of framework 1 define a panel space 22, which includes the panel recess 21, for holding the light-transmissive panel 4. The hinge members 6, 15 can be detached from each other so that the grillwork can be disconnected from said framework for ease of servicing.

In the presently preferred embodiment, the grill panel 19 is fabricated from steel sheet material cut in a decorative pattern. The preferred method of manufacture is a laser cutting process, which provides high edge quality and high precision. Other suitable methods may be used, such as punching, plasma cutting, and water-jet cutting; however, edge quality diminishes with these processes as compared to laser cutting. Preferably, the grillwork 2 is painted or coated with another suitable finish known in the art to protect the grillwork surfaces against corrosion.

Preferably, the light-transmissive panel 4 is constructed of a rigid material, such as a rigid plastic material, and is sized to fit into the panel recess 21 in the grillwork 2. With the barrier assembly 11 in the closed position, the panel 4 is secured into the panel space 22 between the framework 1 and the grillwork 2. The light-transmissive panel can be transparent or translucent. For climates where the sun is intense, the light-transmissive panel 4 can have a translucent or a dark transparent property, such as a "smoked-color or tint," to reduce the intensity of penetrating light, thereby reducing the amount of radiant heat radiating through the light well into the interior of the room.

The above-described; embodiment of a light well barrier assembly in accordance with the present invention possesses numerous advantages. It provides a security barrier, a thermal barrier, a means for controlling light intensity, and a decorative light well grill for a skylight. It is a separate assembly from the skylight structure and therefore can be mounted without removal or modification to an existing skylight structure. Variations in the light well opening are easily accounted for because the barrier assembly does not have to exactly match physical dimensions of the opening. Since, the barrier assembly is comprised of flat panel-like components, the profile of the grill is not obtrusive and blends with the ceiling surface. Since the grill panel is cut from a flat material, many decorative designs can be incorporated allowing for increased aesthetic value.

Additional advantages, modifications and variations will readily occur to those skilled in the art. Such variations may include, for example, using different materials such as galvanized steel or aluminum for the framework and grillwork construction and using a non-welded framework or grillwork. The decorative pattern of the grill panel may be any design desired. Therefore, the invention in its broader aspects is not limited to the specific details, representative devices and illustrative examples shown and described. Accordingly, departures may be made from such details without departing from the spirit or scope of the general inventive concept as defined by the appended claims and their equivalents.

What is claimed is:

1. A barrier assembly for a skylight well opening in a ceiling surface, the barrier assembly comprising:

a framework including a peripheral frame sized to circumscribe the light well opening;

securing means for securing the framework in a position relative to the ceiling surface so that the peripheral frame circumscribes the light well opening;

a grillwork adapted to mate with the framework in a closed position wherein the grillwork and framework define a panel space;

hinge means for hingedly attaching the grillwork to the framework;

a light-transmissive panel sized to fit within the panel space; and fastener means for securing the grillwork to the framework in the closed position.

2. The skylight well barrier assembly according to claim 1 wherein the grillwork includes a grill panel fabricated from sheet metal.

3. The skylight well barrier assembly according to claim 1 wherein the panel space is defined, at least in part, by a panel recess in the grillwork.

4. The skylight well barrier assembly according to claim 3 wherein the recess in the grillwork is defined in part by a spacer disposed on the grillwork.

5. The skylight well barrier assembly according to claim 1 wherein the panel space is defined, at least in part, by a recess in the framework.

6. The skylight well barrier assembly according to claim 5 wherein the recess in the framework is defined in part by a spacer disposed on the framework.

7. The skylight well barrier assembly according to claim 1 wherein the fastener means includes threaded inserts secured in the framework.

8. The skylight well barrier assembly according to claim 7 wherein the threaded inserts are corrosion resistant.

9. The skylight well barrier assembly according to claim 1 wherein the framework and grillwork include a corrosion-resistant coating.

10. A barrier assembly for a skylight light well opening in a ceiling surface, the barrier assembly comprising:

a framework having a generally flat peripheral frame sized to circumscribe the light well opening and a hinge member, the framework being adapted to be secured to the ceiling surface so that the frame circumscribes the light well opening;

a grillwork having a grill panel, a generally flat peripheral member and a hinge member adapted to hingedly attach to the framework hinge member so that the grillwork and framework can be moved between an open position and a closed position;

the grillwork being adapted to releasably attach to the framework in the closed position wherein the grillwork and framework define a panel space; and a light-transmissive panel sized to fit within the panel space.

11. The skylight well barrier according to claim 10, wherein the grill panel is fabricated from sheet metal.

12. The skylight well barrier according to claim 10 wherein the panel space is defined, at least in part, by a recess in the grillwork.

13. The skylight well barrier according to claim 12 wherein the recess in the grillwork is defined in part by a spacer disposed on the grillwork.

14. The skylight well barrier according to claim 10 wherein the panel space is defined, at least in part, by a recess in the framework.

15. The skylight well barrier according to claim 14 wherein the recess in the framework is defined in part by a spacer disposed on the framework.

16. The skylight well barrier according to claim 10 wherein the fastener means includes threaded inserts secured in the framework.

17. The skylight well barrier according to claim 16 wherein the threaded inserts are corrosion resistant.

18. The skylight well barrier according to claim 10 wherein the framework and grillwork include a corrosion-resistant coating.

* * * * *